United States Patent [19]

Gradeff et al.

[11] Patent Number: 4,836,830

[45] Date of Patent: Jun. 6, 1989

[54] RARE EARTH COMPOSITIONS FOR DIESEL FUEL STABILIZATION

[75] Inventors: Peter S. Gradeff, Pottersville; John F. Davison, Edison, both of N.J.

[73] Assignee: Rhone-Poulenc Inc., Monmouth Junction, N.J.

[21] Appl. No.: 196,899

[22] Filed: May 18, 1988

Related U.S. Application Data

[63] Continuation of Ser. No. 909,782, Sep. 19, 1986, abandoned.

[51] Int. Cl.[4] ..... C10L 1/18; C10L 1/30

[52] U.S. Cl. ..... 44/57; 44/67; 44/68; 44/70

[58] Field of Search ..... 44/57, 68

[56] References Cited

U.S. PATENT DOCUMENTS

| | | | |
|---|---|---|---|
| 2,128,685 | 8/1938 | Yates | 44/56 |
| 2,221,839 | 11/1940 | Lipkin | 44/56 |
| 2,658,823 | 11/1953 | Andress, Jr. | 44/62 |
| 2,737,932 | 3/1956 | Thomas | 44/68 U X |
| 2,774,656 | 12/1956 | Newman et al. | 44/57 |
| 3,130,017 | 4/1964 | Shapiro et al. | 44/68 |
| 3,328,440 | 6/1967 | Shapiro et al. | 44/68 |
| 3,794,473 | 2/1974 | Eisentraut et al. | 44/68 |
| 3,976,437 | 8/1976 | Shang et al. | 44/56 |
| 4,207,078 | 6/1980 | Sweeney et al. | 44/68 |
| 4,251,233 | 2/1981 | Sievers et al. | 44/68 |
| 4,264,335 | 4/1981 | Bello et al. | 44/68 |
| 4,336,148 | 6/1982 | Wirth et al. | 44/68 |
| 4,474,579 | 10/1984 | Wilderson et al. | 44/57 |
| 4,522,631 | 6/1985 | Mourao et al. | 44/57 |
| 4,568,357 | 2/1986 | Simon | 44/57 |
| 4,568,360 | 2/1986 | Brisset et al. | 44/68 |

FOREIGN PATENT DOCUMENTS

| | | |
|---|---|---|
| 1571210 | 7/1980 | United Kingdom . |

*Primary Examiner*—William R. Dixon, Jr.
*Assistant Examiner*—E. McAvoy
*Attorney, Agent, or Firm*—Morgan & Finnegan

[57] ABSTRACT

A method for stabilizing diesel fuel for substantially reducing precipitation by adding to the diesel fuel an organometallic compound containing derivatives of one or more trivalent rare earth elements, excluding cerium.

13 Claims, No Drawings

RARE EARTH COMPOSITIONS FOR DIESEL FUEL STABILIZATION

This is a continuation of co-pending application Ser. No. 909,782, filed on Sept. 19, 1986, now abandoned.

BACKGROUND OF THE INVENTION

This inventiion relates to a method for improving the stability of diesel fuel compositions by adding to diesel fuel compositions certain rare earth-organic compounds.

Diesel fuel compositions are known to be very unstable. The expression "diesel fuel" is employed in the description and claims to designate the hydrocarbon fraction which distills from kerosene. Generally, diesel fuel comprises a mixture of hydrocarbons boiling in the range from about 350° to about 700° F. The property requirements of diesel fuel given in Federal Specification VV-F-800 as of 1967 are given in the approximate ranges set forth below. Diesel fuels are graded as DF-A (arctic), DF-1 (winter), DF-2 (regular) and DF-4 (heavy). Arctic grade is used in high-speed, automotive-type diesel engines and pot-type burner space heaters in environments having ambient temperatures below −25° F. Winter-grade is used in high-speed automotive service where temperatures are as low as −25° F. Regular grade diesel fuel is used in automotive, high-speed engines and in medium-speed stationary engines where ambient temperatures are above 20° F. Heavy grade diesel fuel is used in low and medium-speed engines.

The properties of such fuels include flash points ranging from 100° F. (arctic) to 130° F. (heavy); a cloud point of −50° F.; a pour point of −70° F.; a kinematic viscosity (at 100° F.) ranging from a minimum of 1.4–5.8 centistokes to a maximum of 4.0–20.6 centistokes; a limit as to water and sediment content (volume percent) from 0.03 to 0.50%; sulfur content from 0.25 to 1.5% carbon residue (an 10% residuum) of 0.12 to 05% maximum; ash content, 0.01 to 0.10 percent maximum; corrosion (measured by copper strip, 3 hr. at 122° F., ASTM number, max.) of 2–3; and ignition quality (cetane number, minimum) of 35 to 40. Further information concerning diesel fuels may be found in Bland, et al., Editors, "Petroleum Processing Handbook" (McGraw-Hill Book Co., 1967), pp. 11–35 et seq., hereby incorporated herein be reference.

Diesel fuel contains a great number of constituents. In addition to the oil fractions used as fuel, many chemical components are included fuel for several purposes. These chemical additives are used e.g., for oxidation inhibition to prevent sludge formation, corrosion prevention, for detergent and dispersant action, for emulsification, metal deactivation, antistatic action and as biocides.

An important problem in formulating diesel fuel is that some of the components, unsaturated hydrocarbons for instance, tend to react and precipitate out of the composition during storage, causing various concerns including fouling of tanks and engines. Further, some of the additives become selectively combined with the precipitate and are no longer present in the diesel fuel composition and, hence, cannot perform their intended functions.

One of the most important classes of diesel fuel additives is that of oxidation inhibitors. Because diesel fuel is a mixture of hydrocarbons, it is highly susceptible to free radical oxidation and formation of acids, ketones, aldehydes and esters. Oxidation forms gums which become colloidal, agglomerate and precipitate as sludge. Sludge can plug oil lines, strainers and burner nozzles.

Many oxidation inhibitors function by removing the peroxy radicals from the reaction chain, thus stopping the reaction. Phenol-type oxidation inhibitors such as 2,4-dimethyl-6-tert-butyl phenol and 2,6-di-tert-butyl-4-methyl phenol function in this manner. Other oxidation inhibitors include amines such as N,N'-di-sec-butyl p-phenylene diamine and amine borates, phosphorus- and sulfur-containing compounds such as esters of dithiophosphoric acid, barium and zinc salts of these acids and glycerol acids containing metal oxides.

Another important class of diesel fuel additives is that of metal deactivators. These compounds generally act to chelate the metals found in diesel fuels by surrounding and isolating metals in complexes that remain soluble in the fuel instead of precipitating.

Various other additives have been suggested for use in diesel fuels to reduce particulate emissions. U.S. Pat. Nos. 3,410,670; 3,413,102; 3,539,312 and 3,499,742 are representative ones which describe smoke suppressants that can be employed in diesel fuels. U.S. Pat. No. 4,207,078 sets forth a method for reducing soot and visible particulate matters from the exhaust of diesel fueled engines by incorporating in the diesel fuel an additive consisting of a mixture of an oxygenated compound and an alkylcyclopentadienyl manganese tricarbonyl.

U.S. Pat. No. 4,222,746 describes another group of compounds for reducing soot and visible particulates emitted from the exhaust of diesel fueled internal combustion engines. According to this patent, the addition of wax to diesel fuel which oxidizes along with a fuel soluble organometallic compound such as alkyl cyclopentadienyl manganese tricarbonyl complex salts can reduce emissions of soot and visible particulates.

Due to environmental, regulatory and economic concerns, combustion promoters have been developed to improve the efficiency of the combustion of the hydrocarbons in diesel fuel. During the operation of a diesel-fueled engine, the combustion promoter serve to encourage the burning of the hydrocarbons.

According to U.S. Pat. No. 4,522,631, certain soluble rare earth octoate compounds of the formula:

$$C_7H_{15}-\overset{\overset{\displaystyle O}{\|}}{C}-O-M$$

have been added to diesel fuel as combustion promoters. Cerium octoates were found to be particularly effective. However, cerium octoates tend to contribute to the formation of precipitate and sludge in diesel fuels.

An objective of this invention is to provide compounds for stabilizing diesel fuel so as to substantially prevent diesel engine fouling by reducing the accumulation of sludge in diesel fuel.

Another objective of this invention is to provide a method of reducing precipitation of particulates in diesel fuel during storage periods over relatively long periods of time.

Another objective of this invention is to provide a method of maintaining the various additives of diesel fuel in solution during storage so as to allow them to perform their functions during storage and combustion.

Yet another objective of this invention is to provide a method for substantially reducing precipitation in diesel fuels using certain rare earth compounds.

SUMMARY OF THE INVENTION

This invention relates to a method of stabilizing diesel fuels by substantially reducing precipitation and sludge formation during storage and transportation by adding to the diesel fuel certain lanthanide compounds. Preferably such compounds contain carboxyl groups linked to said lanthanides through an oxygen atom, as follows:

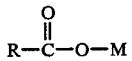

Wherein M is yttrium, lanthanum, praseodymium, neodymium, samarium, europium, gadolinium, or mixtures thereof, also mixtures that may contain traces comprising some of the remaining trivalent lanthanides such as terbium, dysprosium, holmium, erbium, promethium, thulium, ytterbium and lutetium.

The most abundant of the lanthanides, cerium, is not included in this group. Surprisingly and remarkably cerium compounds do not function in the method of this invention. Probably, cerium compounds behave differently due to the ease of cerium to assume a tetravalent state, which appears responsible for the reactivity vis-a-vis some of the fuel components.

R is a hydrocarbon group containing from about 3 to about 25 carbon atoms which can form straight or branched chains or comprise cyclic, alicyclic or aromatic groups, R being attached to a carboxyl group —COO—. Typical carboxylic groups that renders the lanthanide soluble in diesel fuel are, for instance, 2-ethyl hexoate (called octoate), naphthenate, neodecanate, butyrate, hydroxy stearate, and the like.

The diesel fuel additive composition used according to the method of this invention can be added to diesel fuels, preferably in the form of a diesel-fuel soluble concentrate in the said diesel fuel. However, it may be added according to any method known to those of skill in the art.

The rare earth diesel fuel additive should be soluble in the diesel fuel to the extent of its intended concentration. The quantity of rare earth element present in the diesel fuel can vary from about 5 to about 500 parts per million (ppm). Preferably, the quantity of rare earth element should be from about 5 to about 150 ppm.

The following examples illustrate the method of this invention. Of course, they do not serve to limit, but merely to illustrate, the scope of this invention. The accelerated stability test adopted here is one of many ways to demonstrate the effect of the lanthanide additives on the stability of diesel fuel.

EXAMPLES 1-12

All of the examples were performed under rigorously identical conditions. Each example represents a group of tests run on the same day. A quantity of 350 ml of diesel fuel was filtered, placed in a specially made 1 liter pyrex flask. A quantity of the additive was introduced as set forth in the Table under the column labelled "CONCN OF ADDITIVE". concentration is based on the weight of rare earth element. The particular additives used in each test are set forth in the Table under the column labelled "ADDITIVE." The flask was purged with oxygen, capped and heated for 16 hours at 100° C. in the absence of light.

After cooling, each sample was filtered through a millipore filter, the flask washed four times with hexane and the filtrate dried. The weight of the dried precipitate was recorded. The flask was then washed three times with a "tri-solvent mixture" (containing the solvents toluene, methanol and acetone) to dissolve the gums and the washes evaporated. The weight of the gums taken by the "tri-solvent" mixture were recorded separately. The value shown in the Table under "MG SEDIMENT/100 Ml Fuel" reflects the resultant total weight of precipitate and gums per 100 ml of diesel fuel. In Examples 9-12, commercially available stabilizers were compared to the rare earth stabilizers used in the method of this invention. Commercial Stabilizer A is Lubrizol OS No. 10371A. Commercial Stabilizer B is Lubrizol OS No. 6830. Commercial Stabilizer C is Lubrizol OS No. 42789A.

The tests were run with diesel fuel samples from four different sources. Three of the diesel samples were specially selected for their short storage stability due to their compositions, which tend to precipitated on storage. The fourth sample was a commercially available diesel fuel. During each consecutive test on a given day, the fuel sample tended to evolve with time as deposition in the container took place. The fuel sample therefore became cleaner and formed fewer and fewer deposits on each test date. Therefore, only values within a given example can be compared.

Samples are referred to by their abbreviated elemental names, except for the samples labelled "RE", which stands for a mixture of rare earth elements, cerium, praseodymium and neodymium.

All cerium derivatives showed high reactivity and formed deposits well in excess of the blank. Surprisingly, the use of lanthanum, praseodymium, neodymium, and other lanthanide organometallic complexes as set forth appear to reduce the deposit and apparently change the nature of the deposit as shown by the color of the deposit.

TABLE I

| EXAMPLES | ADDITIVE | CONCN. OF ADDITIVE | MG. SEDIMENTS/ 100 ml Fuel | COLOR OF SEDIMENT |
|---|---|---|---|---|
| 1 | Blank (no additive) | | 3.4 | Black |
| | Ce Neodecanoate | 100 ppm | 33.0 | Brown |
| | Ce Octoate | 100 ppm | 36. | Brown |
| | RE Octoate | 100 ppm | 8.3 | Brown |
| | Nd Octoate | 100 ppm | 2.0 | Off-white |
| | La Octoate | 100 ppm | 1.4 | Off-white |
| | Ni (Organo Soluble) | 100 ppm | 9.4 | Gray |
| | Co (Organo Soluble) | 100 ppm | 10.6 | Dark Brown |
| | Cu (Organo Soluble) | 100 ppm | 24.9 | Dark Brown |
| | Fe (Organo Soluble) | 100 ppm | 10.9 | Dark Brown |

TABLE I-continued

| EXAMPLES | ADDITIVE | CONCN. OF ADDITIVE | MG. SEDIMENTS/ 100 ml Fuel | COLOR OF SEDIMENT |
|---|---|---|---|---|
| 2 | Blank (no additive) | | 2.0 | Black |
| | Ce-Acetylacetonate | 100 ppm | 34.0 | Brown |
| | RE Neodecanoate | 100 ppm | 26.0 | Brown |
| | Ce Octoate | 100 ppm | 18.0 | Brown |
| | Ce Naphthenate | 100 ppm | 23.7 | Brown |
| | La Octoate | 100 ppm | 2.9 | Off-white |
| 3 | Blank (no additive) | | 4.3 | Black |
| | Ce Octoate | 100 ppm | 29.7 | Brown |
| | La Octoate | 100 ppm | 0.7 | Beige |
| 4 | Blank | | 4.1 | Black |
| | Pr + Nd Octoate | 100 ppm | 0.6 | Beige |
| | Pr + Nd Octoate + 5% Ce Octoate | 100 ppm | 2.5 | Brownish |
| | La Octoate | 100 ppm | 0.4 | Beige |
| 5 | Blank (no additive) | | 4.3 | Black |
| | Ce Octoate | 100 ppm | 21.3 | Brown |
| | La Octoate | 100 ppm | 1.2 | Off-white |
| | La Octoate + 10% Ce Octoate | 100 ppm | 5.7 | Brown |
| 6 | Blank (no additive) | 100 ppm | 4.3 | Black |
| | Ce Octoate | 100 ppm | 29.7 | Brown |
| | La Octoate | 100 ppm | 0.7 | Beige |
| | Pr, Nd, Sm, and Eu Octoate | 100 ppm | 0.5 | Beige |
| 7 | Blank (no additive) | | 4.1 | Black |
| | Pr, Nd, Eu and + 5% Ce Octoate | 100 ppm | 2.5 | Brownish |
| | Pr, Nd and Eu Octoate | 100 ppm | 0.6 | Beige |
| | La Octoate | 100 ppm | 0.4 | Beige |
| 8 | Blank (no additive) | | 7.7 | Black |
| | Commercial Stabilizer A | 134 ppm | 3.0 | Off-white |
| | La Octoate | 100 ppm | 3.9 | Off-white |
| 9 | Blank (no additive) | | 8.9 | Black |
| | Commercial Stabilizer B. | 62 ppm | 6.6 | Black |
| | La Octoate | 50 ppm | 3.6 | Beige |
| 10 | Blank (no additive) | | 9.4 | Black |
| | Commercial Stabilizer C | 35 ppm | 7.1 | Black |
| | La Octoate | 30 ppm | 3.0 | Beige |
| 11 | Blank | | 8.3 | Black |
| | Commercial Stabilizer A | 67 ppm | 2.4 | Gray |
| | La Octoate | 20 ppm | 3.2 | Light Brown |
| 12 | Blank | | 1.31 | Brown |
| | Commercial Stabilizer B | 13.4 ppm | 0.63 | Brown |
| | Nd Octoate | 14 ppm | 0.38 | (Light) (color undetermined) |
| | Pr Octoate | 15.5 ppm | 0.34 | Off-white |
| | Y Octoate | 15 ppm | 0.50 | Off-white |

What is claimed is:

1. A method of inhibiting oxidation to reduce precipitation and sludge formation during storage and transportation of diesel fuel consisting essentially of adding to said diesel fuel a rare earth organometallic compound of the formula:

$$R-\overset{\overset{\displaystyle O}{\|}}{C}-OM$$

wherein M is one or more rare earth elements selected from the group consisting of yttrium, lanthanum, praseodymium, neodymium, samarium, europiums, gadolinium, terbium, dysprosium, holmium, erbium, promethium, thulium, ytterbium and lutetium and R is a hydrocarbon group having from 3 to 25 carbon atoms, thereby substantially inhibiting said oxidation of said diesel fuel.

2. A method according to claim 1 consisting essentially of adding a compound to said diesel fuel wherein R is a straight or branched alkyl group, a heterocyclic group, an alicyclic group or an aromatic group.

3. The method of claim 2 wherein R is a straight alkyl group.

4. The method of claim 2 wherein R is a branched alkyl group.

5. The method of claim 2 wherein R is a heterocyclic group.

6. The method of claim 2 wherein R is an alicyclic group.

7. The method of claim 2 wherein R is an aromatic group.

8. A method according to claim 1 consisting essentially of adding a compound to diesel fuel wherein said compound is an octoate, a naphthenate, a neodecanate, a butyrate or an hydroxy stearate.

9. A method according to claim 1 consisting essentially of adding to diesel fuel a compound of the formula:

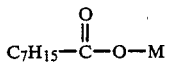

10. A method according to claim 1 wherein said organometallic compound is added to said diesel fuel is a diesel fuel-soluble concentrate in an amount such that the concentration of rare earth element in said diesel fuel is between about 5 and about 500 parts per million.

11. A method according to claim 10 wherein said concentration is between about 5 and about 150 parts per million.

12. A method according to claim 1 which substantially reduces precipitation in said diesel fuel under storage conditions equivalent to holding the diesel fuel at a temperature of 100° C. in the presence of oxygen for at least 16 hours.

13. A method of claim 1 wherein rare earth elements are selected from the group consisting of yttrium, lanthanum, praseodymium, neodymium, samarium, and europium.

* * * * *